US005677662A

United States Patent [19]

Bresolin et al.

[11] Patent Number: 5,677,662

[45] Date of Patent: Oct. 14, 1997

[54] HEAT-SENSITIVE RESISTIVE COMPOUND AND METHOD FOR PRODUCING IT AND USING IT

[75] Inventors: Valerio Bresolin, Vicenza; Daniele Ragazzon, Treviso, both of Italy

[73] Assignee: Hydor S.R.L., Bassano del Grappa, Italy

[21] Appl. No.: 669,561

[22] PCT Filed: Jan. 11, 1995

[86] PCT No.: PCT/EP95/00076

§ 371 Date: Jul. 12, 1996

§ 102(e) Date: Jul. 12, 1996

[87] PCT Pub. No.: WO95/19626

PCT Pub. Date: Jul. 20, 1995

[30] Foreign Application Priority Data

Jan. 17, 1994 [IT] Italy ..... V194A0004

[51] Int. Cl.[6] ..... H01C 7/10

[52] U.S. Cl. ..... 338/22 R; 338/225 D

[58] Field of Search ..... 338/20, 22 R, 338/225 D, 24, 25; 427/58; 419/6, 8; 252/511; 128/724

[56] References Cited

U.S. PATENT DOCUMENTS

| | | | |
|---|---|---|---|
| 4,126,824 | 11/1978 | Thornburg et al. | 324/62 |
| 5,093,036 | 3/1992 | Shafe et al. | 252/511 |
| 5,181,006 | 1/1993 | Shafe et al. | 338/22 R |
| 5,344,591 | 9/1994 | Smuckler | 252/511 |
| 5,358,793 | 10/1994 | Hanada et al. | 428/560 |
| 5,374,379 | 12/1994 | Tsubokawa et al. | 252/511 |
| 5,480,728 | 1/1996 | Tkaczyk | 428/548 |
| 5,558,099 | 9/1996 | Bowman et al. | 128/724 |
| 5,613,181 | 3/1997 | Natarajan et al. | 419/6 |

FOREIGN PATENT DOCUMENTS

| | | |
|---|---|---|
| 512703 | 11/1992 | European Pat. Off. . |
| 517372 | 12/1992 | European Pat. Off. . |
| 534721 | 3/1993 | European Pat. Off. . |
| 9003420 | 5/1990 | WIPO . |
| 9119297 | 12/1991 | WIPO . |

*Primary Examiner*—Adolf Berhane

*Attorney, Agent, or Firm*—McAulay Fisher Nissen Goldberg & Kiel, LLP

[57] ABSTRACT

A heat-sensitive resistive compound is formed by a mixture of particles of at least one electrically conducting material (A) in the solid state and of at least one resin (B) in the solid state; the mixture is dispersed in at least one liquid solvent (C); the percentage by weight of the electrically conducting material (A) with respect to the total weight of the anhydrous compound is 5% to 70%. The resistance of the compound after a furnace process increases, as the temperatures rises, in a substantially linear manner for temperatures that are approximately lower than or equal to 70° C. and in a substantially exponential manner for temperatures that are approximately higher than 70° C. The relative increase in the resistance of the compound with respect to its resistance at ambient temperature is at least 3 for temperatures higher than 100° C. and at least 5 for temperatures above 115° C. The method for providing a PTC device includes the deposition, by printing or screen-printing, of the resistive compound on a flexible or rigid laminar support made of insulating material (2) along an electric path (3) that connects conducting paths (6) which form electrodes; the compound is deposited when cold and is subjected to one or more furnace processes at a temperature that is at least equal to 110° C. for a period and a number of times that are sufficient to achieve the complete evaporation of the solvent (C) and the adhesion of the resin (B) to the substrate.

12 Claims, 1 Drawing Sheet

HEAT-SENSITIVE RESISTIVE COMPOUND AND METHOD FOR PRODUCING IT AND USING IT

The present invention relates to a heat-sensitive resistive compound and to a method for producing it and using it, particularly for manufacturing electric devices, generally known as PTC (positive temperature coefficient) devices, that increase their internal resistance as temperature increases.

A typical example of the application of PTCs is constituted by relays for protecting against overcurrents in electric circuits. If a short circuit occurs, these devices limit the current to a preset value with a sudden increase in resistance and on the other hand restore normal flow when the short circuit is eliminated. These known devices are constituted by an electrically conducting material and optionally by a heat-conducting material which are mixed together and immersed in a polymeric matrix in the plastic or semisolid state. The compound is then stratified and highly compressed between pairs of flat electrodes which are connected to the terminals of a circuit. For low or normal operating temperatures, for example up to approximately 80° C., the resistance of these devices is extremely low, for example a few hundredths of an ohm, and increases suddenly to tens or hundreds of ohms above these temperatures.

PTC devices are also used as heaters for liquids or solids or as temperature sensors.

A possible application of PTC heaters might be constituted by electrically heated rear-view mirrors for motor vehicles, which are meant to prevent the forming of condensation or ice on the cold reflecting surfaces. Conventional heating devices for mirrors are not based on the PTC effect but are generally constituted by a sheet of resistive material which is applied on an insulating layer. The resistive material adheres to the surface to be heated, and is etched by etching with acid (so-called "etched foil") so as to form electrical paths that have a preset geometry and length and are distributed over the support. A first drawback of these conventional heaters is that the etching process is highly polluting due to the disposal of the substances used in etching the metal layer. A second drawback of these devices is their low power, which however is sufficient for the intended purposes. Finally, since they do not use the PTC effect, these devices require thermostatic regulators inserted in the electric supply circuit.

Some heaters that use the PTC effect are known; they are constituted by a special electrically conducting ink which is deposited on an insulating layer with printing or screen-printing methods so as to produce an electric path that has a preset pattern. The ink is generally constituted by a solution of electrically conducting materials dispersed in a liquid. A characteristic of this type of device is the fact that at normal operating temperatures they have relatively low resistances which allow them to be supplied with currents at a voltage between 12 and 24 V and with relatively low power levels, for example under 10 W. Furthermore, their ratio between resistance at low or normal temperature and resistance at high temperature, that is to say above 110° C., is less than 3, and this can be a considerable limitation in some technological fields.

A relatively recent application of PTC devices is constituted by heaters for aquariums or fishponds or for photographic baths. Such cases require a relatively high power level, on the order of 100–200 W for operating temperatures on the order of 27° C. For biological or chemical reasons, it is also necessary to ensure that the operating temperature is definitely constant. In case of accident, for example if the level of the liquid decreases and the heater operates in air, it is desirable that the dissipated power drop to levels around 15–20 W, which correspond to temperatures on the order of 100°–120° C., to avoid overheating and thus irreversible damage to the device.

Due to the polluting characteristics of the "etched foil" process, this method for manufacturing electric heaters has been discarded in favor of the use of electrically conducting inks with PTC behavior also because it requires the use of additional devices for temperature control.

However, PTC inks with resistances that can be supplied, at low or normal operating temperatures, with power at voltages above 24 V, for example at the mains voltage of approximately 220 V, and with operating power levels on the order of 100–200 W, are not known in the current state of the art. PTC inks that allow to achieve, at high temperatures, that is to say above 110° C., peak resistance values between 5 and 10 times those at normal temperature, in order to sharply limit the power level and accordingly the temperature of the device at high temperature, are also not known.

The aim of the present invention is to overcome the drawbacks of the prior art by providing a heat-sensitive resistive compound that has a relatively high resistance at low temperature so as to allow to supply it, at ambient temperature, with voltages above 24 V, for example with the normal household electricity of 220 V.

Within the scope of this aim, an object of the present invention is to provide a PTC ink whose resistance is variable as a function of the temperature, with a ratio between high-temperature resistances and low-temperature resistances which is higher than those of the past, for example between 3 and 10 and over for temperatures above 110° C.

Another object is to provide a PTC ink whose electric resistance can be changed by varying its composition.

Another object is to provide a PTC ink that has, once dried, elasticity characteristics that make it suitable to be printed or screen-printed on flexible or deformable supports without damaging the conductive electric paths.

Another object is to use a heat-sensitive resistive compound according to the invention to provide an ecological and reliable PTC device which is particularly suitable to heat liquids and solids at a substantially constant temperature.

This aim, these objects, and others which will become apparent hereinafter are achieved by a method of preparation of a heat-sensitive resistive compound according to the teachings of the main.

The intended aim and objects are also achieved by a method for manufacturing a device with positive resistance coefficient or PTC device according to the the invention as described herein.

Finally, the aim and objects of the present invention are achieved by a device with positive resistance coefficient or PTC device.

With a resistive compound according to the invention it is possible to print or screen-print an electrically conducting resistive path, providing PTC devices that can generate heat with specific power levels of at least 0.5 W/sq cm, using a mains power supply at approximately 220 V.

A device according to the invention can be used to heat a liquid or solid medium by full immersion or contact with the medium to be heated, and in case of a sudden change in the heat absorption of the medium, for example if the level of the liquid in an aquarium drops, the temperature of the resistive path rises locally, correspondingly increasing its resistance, which self-limits the flow of current in the exposed region.

Further characteristics and advantages of the invention will become apparent from the following description, which is given only by way of non-limitative example with the aid of the accompanying drawings, wherein.

Figure 1:
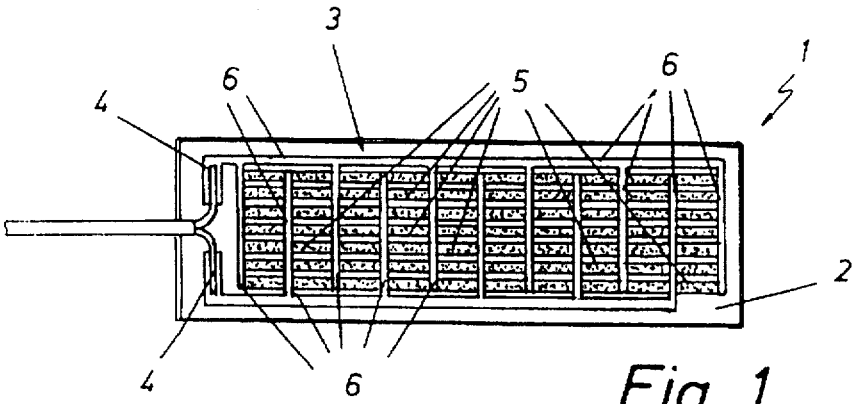
FIG. 1 is a schematic view of a PTC heating device according to the invention.
Figure 3:
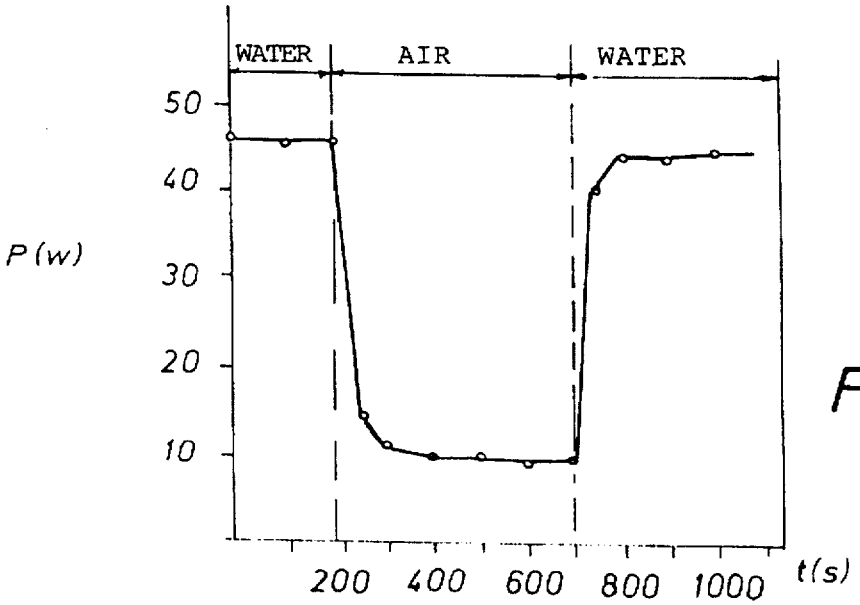

FIG. 3 plots the power absorbed by the device of FIG. 1 when it is immersed in water and when it is removed from the bath.

With reference to the above figures, a PTC heating device, designated by the reference numeral 1, is generally formed by an insulating support 2 on which an electric path 3 is drawn, with terminals 4 that can be connected to an external electric line.

The support 2 is preferably constituted by a sheet or foil of plastic material, for example polyester, Kevlar, or Kapton (trade marks), so that it is deformable to allow its insertion, for example inside a tubular container of heat-conducting material in contact with its internal wall.

The electrical path 3 of the PTC device is more specifically formed by a series of bands 5 of a heat-sensitive resistive compound, which will be described in greater detail hereinafter; these bands can be drawn on the support 2 by depositing with a brush, by printing, or by screen-printing with appropriate frames.

The bands 5 are arranged in parallel lines between conducting paths 6 that form electrodes and are in turn connected to terminals 4. The conducting paths 6 also can be produced by using deposition, printing, or screen-printing methods with a known type of conducting ink, for example based on silver or on another conducting metal in the pure state or as an alloy.

The resistive compound or ink used to draw the bands 5 is essentially constituted by a mixture of solid particles of at least one electrically conducting material, referenced by the letter A for the sake of convenience, and of at least one synthetic resin, referenced by the letter B for the sake of convenience, dispersed in an appropriate solvent, referenced by the letter C for the sake of convenience.

The electrically conducting material A is preferably constituted by carbon in the state of powdered coal, of the type normally known as carbon black, obtained by a furnace process, or in the state of coal fibers, or powdered or lamellar graphite. The carbon can be in the pure state or combined with other electrically conducting materials, such as nickel, silver, gold, platinum, copper, tin, iron, aluminum, tungsten, and others, which have an electric resistivity of less than 0.1 μΩ/m, reduced to powder form with a grain size of for example 0.1 μm to 100 μm.

These metals can be in the pure state or can be alloyed or mixed together in different proportions according to the desired resistivity. As an alternative, additions of oxides or metallic compounds such as for example TiO and $TiB_2$ may be present.

The electrically conducting material A can constitute 5 to 70% of the total weight of the anhydrous compound. By using lower percentages, close to the lower limit, one obtains compounds that have high electrical resistivity at ambient temperature, for example between 300 and 500 kΩ/square. Compounds thus obtained are more suitable for PTC devices that have high absorption and a large number of resistive bands connected in parallel, in order to lower the total resistance. By using percentages of conducting mixture that are close to the upper limit, one obtains compounds that have a relatively low resistivity, for example starting from 5 kΩ/square at ambient temperature; this resistivity allows to produce PTC devices with a smaller number of resistive bands in parallel and with lower power ratings.

The synthetic resin B can be constituted by a polymer which preferably belongs to the class of acetates or fluorine-containing plastics. Other classes of polymers that can be used can be constituted by polyolefins, methacrylates, or cellulose esters, or by the combination of at least two of the above mentioned polymers. Resins in the solid state can be finely ground with a grain size of for example 20 to 200 μm and then mixed with the powder of conducting material.

The mixture of the material A and of the resin B can be dispersed in a solvent C, chosen among chlorohydrocarbons, esters, ethers, ester-ethers, or a mixture thereof. The percentage of the solvent C by weight with respect to the total compound can be 30% to 80% and depends on the nature of the solvent, of the resins, of the electrically conducting material, and also on the deposition method used, for example on the type of frame used for screen-printing.

Once the compound has been prepared, it is homogenized and applied by deposition, printing, or screen-printing to the laminar support 2 made of dielectric material, forming the resistive paths 3 between the conducting paths.

The printed or screen-printed support is then subjected to one or more furnace process cycles at a temperature above 110° C. for time periods sufficient to achieve the full evaporation of the solvent and the partial or total adhesion of the resin to the support, thus forming a resistive path which is perfectly anchored to the support, has a substantially uniform composition, an average thickness of 5 to 40 μm, and is highly flexible by virtue of the presence of the polymeric matrix of the resin.

Figure 2:
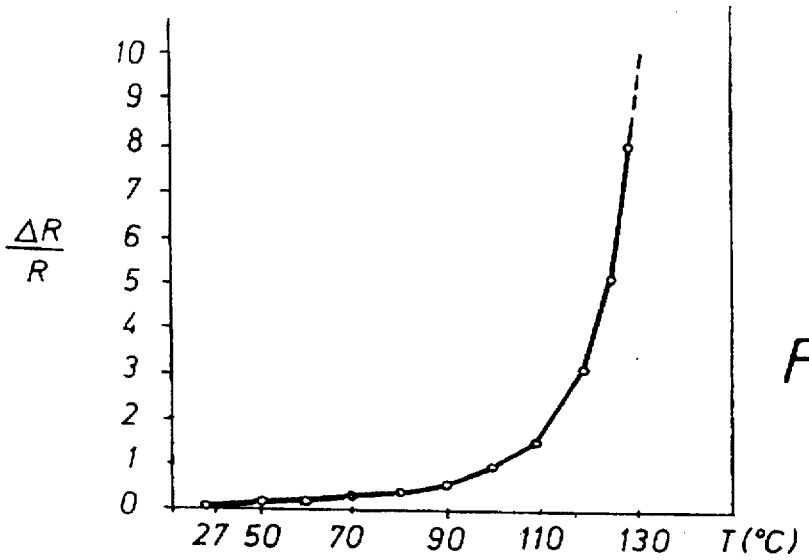
FIG. 2 is a chart that plots the variation of the resistance of the device of FIG. 1 as a function of the temperature detected thereon.

The chart of FIG. 2 has been obtained by measuring the resistance of a device of the above described type, and shows that the resistance of a typical device according to the invention increases in percentage terms with respect to the resistance at the ambient temperature of 27° C. as the temperature increases. In particular, it is noted that the relative increase in resistance with respect to the resistance at ambient temperature, expressed by the ratio $(R-R_0)/R_0$, increases in an approximately linear manner up to approximately 70° C., and that at this temperature it is approximately 50% higher than the resistance at ambient temperature. For temperatures above approximately 70° C., the ratio R/R0 increases in a substantially exponential manner. Furthermore, for temperatures above approximately 110° C., this relative increase is at least equal to 3, whereas above 115° C. it is at least equal to 5. At 125° C., the ratio is between 8 and 13 and can vary, even to a considerable extent, depending on the nature of the compound.

The chart of FIG. 3 shows the behavior of a PTC device from the initial moment, when it is immersed in water, and is then instantaneously removed from the water and left free in air. The axis of the ordinates plots the absorbed power, expressed in watts (W), and the axis of the abscissae plots time, expressed in seconds (s). The chart shows that the initial steady-state power level is approximately 42 W and drops after approximately 50 s to approximately 40% of the initial value and in approximately 100 s to approximately ¼ of the initial value.

Although the compound and the device obtained with it have been described in some preferred embodiments, it is evident that they can be subjected to modifications and variations, all of which are within the scope of the inventive concept expressed in the accompanying claims, which are understood to be all equally protected. In particular, instead of the conducting materials, of the polymers, and of the solvents listed in the description, it is possible to use other technically equivalent ones, provided that they give the same effect and have the same behavior from a chemical-physical point of view.

We claim:

1. A method of preparation of a heat-sensitive resistive compound, particularly suitable for PTC devices, comprising the steps of preparing an anhydrous mixture of particles of at least one electrically conducting material (A) in the solid state and of at least one synthetic resin (B) in the solid state, dispersing and homogenizing said anhydrous mixture in a transient carrier (C), wherein the percentage by weight of said electrically conducting material (A) with respect to the total weight of the anhydrous mixture is from 5% to 70%, characterized in that said at least one electrical conducting material (A) comprises particles of a single carbon black of average size approximately in the range from 0.1 μm to 100 μm, said at least one synthetic resin comprises particles of a polymer or a mixture of polymers selected from among methacrylates and cellulose esters of average size approximately in the range from 20 μm to 200 μm, said transient carrier (C) being a dispersing agent for said at least one electrically conducting material (A) and being chosen from among liquid solvents of said polymer or polymers.

2. A method according to claim 1, wherein said liquid solvent is chosen from among chlorohydrocarbons, esters and ester-ethers.

3. A method according to claim 1, wherein the percentage of weight of said liquid solvent with respect to the total weight of the compound is in the range from 30% to 80%.

4. A method according to claim 1, wherein one or more metals or metal alloys having a resistivity of less than 0.1 μΩ/m are combined with said single carbon black to form said at least one electrically conducting material (A).

5. A method according to claim 4, wherein said metals are chosen from among nickel, silver, gold, platinum, copper, tin, iron, aluminum, titanium, and tungsten.

6. A method according to claim 4, wherein said electrically conducting material (A) further comprises metallic compounds and metal oxides including TiO and TiB2.

7. A method for manufacturing a PTC element comprising the steps of:

preparing a heat-sensitive resistive compound according to claim 1;

screen printing said heat-sensitive resistive compound at cold on a flexible or rigid laminar support of insulating material to form resistive bands suitable to connect conductive paths defining electrodes; and heating the screen printed support by one or more furnace processes at a temperature of at least 110° C. for a sufficient time to achieve full evaporation of the solvent and at least partial adhesion of the resin, wherein the deposition of heat-sensitive resistive compound on the support is adjusted to have bands of average thickness approximately in the range from 5 μm to 40 μm to provide uniform and highly flexible resistive paths.

8. Method according to claim 7, wherein the resistive bands of heat-sensitive resistive compound are deposited on the conducting paths forming electrodes.

9. Method according to claim 7, wherein the conducting paths forming electrodes are deposited on the bands of heat-sensitive resistive compound.

10. A positive resistance coefficient device or PTC device comprising a flexible or rigid laminar support on which conducting paths defining electrodes and resistive bands of heat-sensitive resistive compound are screen printed and-heated according to the method of claim 7.

11. A device according to claim 10, wherein said resistive bands (3) have an average thickness of approximately 5 μm to 40 μm.

12. A device according to claim 11, wherein said resistive bands (3) have a resistance at ambient temperature of at least 5 KΩ/square.

* * * * *